US012312993B2

(12) United States Patent
Olsen

(10) Patent No.: US 12,312,993 B2
(45) Date of Patent: May 27, 2025

(54) TWO ZONE RADIATOR COOLING SYSTEM

(71) Applicant: Volvo Car Corporation, Gothenburg (SE)

(72) Inventor: Hans Erik Olsen, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 38 days.

(21) Appl. No.: 18/325,775

(22) Filed: May 30, 2023

(65) Prior Publication Data

US 2024/0401516 A1 Dec. 5, 2024

(51) Int. Cl.

| | |
|---|---|
| ***F01P 7/16*** | (2006.01) |
| ***F01P 3/18*** | (2006.01) |
| ***F01P 7/14*** | (2006.01) |
| ***F01P 11/02*** | (2006.01) |

(52) U.S. Cl.

CPC *F01P 7/16* (2013.01); *F01P 3/18* (2013.01); *F01P 11/029* (2013.01); *F01P 2007/146* (2013.01); *F01P 2007/168* (2013.01); *F01P 2025/34* (2013.01)

(58) Field of Classification Search

CPC .... F01P 7/16; F01P 3/18; F01P 11/029; F01P 2007/146; F01P 2007/168; F01P 2025/34

See application file for complete search history.

(56) References Cited

U.S. PATENT DOCUMENTS

| | | | | |
|---|---|---|---|---|
| 5,305,826 | A | 4/1994 | Couetoux | |
| 6,196,168 | B1 | 3/2001 | Eckerskorn et al. | |
| 8,991,339 | B2 | 3/2015 | Gooden et al. | |
| 2006/0113068 | A1 | 6/2006 | Desai et al. | |
| 2010/0262301 | A1* | 10/2010 | Schwartz | F01P 7/164 700/282 |
| 2010/0263854 | A1 | 10/2010 | Eckmann et al. | |
| 2011/0073285 | A1* | 3/2011 | Benoit | F28D 1/0443 137/627 |
| 2019/0143921 | A1* | 5/2019 | Tian | F28F 27/02 180/68.1 |
| 2020/0300156 | A1* | 9/2020 | Muto | F01P 11/16 |

OTHER PUBLICATIONS

Yamakawa, Y. et al. | "Impact of Decentralized Controllers for Temperature Control on Control Performance." ASHRAE Transactions; Atlanta vol. 117, (2011): 830-837, 8 pages.

* cited by examiner

*Primary Examiner* — Grant Moubry
*Assistant Examiner* — Ruben Picon-Feliciano
(74) *Attorney, Agent, or Firm* — Amin, Turocy & Watson, LLP

(57) ABSTRACT

The invention is to utilize one radiator instead of two to cool two separate vehicle cooling systems. The main embodiment is a single radiator cooling system that partitions the physical radiator into two separate surface areas that are dedicated for each of the two respective circuits. A processor can control an actuator that drives a screw and plunger mechanism to push and pull a plunger. The plunger separates the two surface areas so as the plunger is moved, a corresponding surface area is increased or decreased for a cooling circuit. An increase in the surface area can provide more cooling for that circuit as the fluid has more core area to travel through. Temperature sensors can provide data to a processor that can adjust the actuator to provide cooling relief to the circuit where its most required.

20 Claims, 9 Drawing Sheets

TWO ZONE RADIATOR COOLING SYSTEM

TECHNICAL FIELD

The disclosed subject matter relates to utilizing a shared controllable radiator for two separate cooling systems for providing cooling power to a vehicle and mitigating system losses in the vehicle.

BACKGROUND

Vehicle radiators are a component of a vehicle's cooling system. Radiators work by removing heat from a vehicle system such as an engine and then dissipating the heat into surrounding air. In combustion engine vehicles, this cooling is a component to the vehicle's engine system and in hybrid vehicles there may be a need for two cooling systems, one for the battery compartment and one for the engine. There may also be another system that could require a connection to a cooling system in the vehicle. This could lead to using two physical radiators which can be more costly and can occupy space better utilized for different functions. The innovation provides a novel method to employ only one radiator to cool two different cooling systems, which can also be referred to as cooling circuits for purposes of discussion.

The above-described background relating to radiators and vehicle cooling systems is merely intended to provide a contextual overview of some current issues and is not intended to be exhaustive. Other contextual information may become further apparent upon review of the following detailed description.

SUMMARY

The following presents a summary to provide a basic understanding of one or more embodiments of the invention. This summary is not intended to identify key or critical elements or delineate any scope of the particular embodiments or any scope of the claims. Its sole purpose is to present concepts in a simplified form as a prelude to the more detailed description that is presented later. In one or more embodiments described herein, systems, devices, computer-implemented methods, apparatuses and/or computer program products that facilitate a radiator capable of controlling two separate cooling systems are described.

As alluded to above, a radiator is a primary component in a vehicle cooling system and a battery pack system (e.g., other systems may also require cooling) and these should be properly cooled to maintain full functionality. A cooling process utilizing radiator modifications can be improved by various techniques, and various embodiments are described herein to such end.

According to an embodiment, a radiator cooling system that can cool two separate cooling circuits by, acquiring a temperature of a circuit, manipulating a flow valve in a circuit to control coolant flow into a radiator, and control an actuator that drives a set of screws, connected to a set of plungers that can control radiator surface area for cooling a circuit. Fluid traveling through a radiator core can be cooled as a radiator acts as a heat sink.

According to another embodiment, a radiator cooling system wherein, tanks of a radiator are designed as straight tubes with a screw and a plunger in each tank and the screws can be synchronized with a gear and shaft mechanism or cog belt. Wherein, a physical radiator is separated into two partitions with distinct radiator surface areas, in which each partition is dedicated to a specific cooling circuit. Each radiator partition surface area can be controlled by a plunger being pulled or pushed by a set of screws and can also be thickened to provide more surface area.

According to another embodiment, a radiator cooling system can employ temperature sensors to detect real-time temperature in a cooling circuit and provide data to a processor which can control an actuator to drive a set of screws into pushing or pulling a set of plungers to optimize a cooling process.

According to another embodiment, a radiator cooling system can manipulate radiator surface area so more or less of the finned tube core of the radiator between the tanks is connected to each of the cooling systems as an actuator elevates or lower a set of plungers.

DETAILED DESCRIPTION

Figure 1:
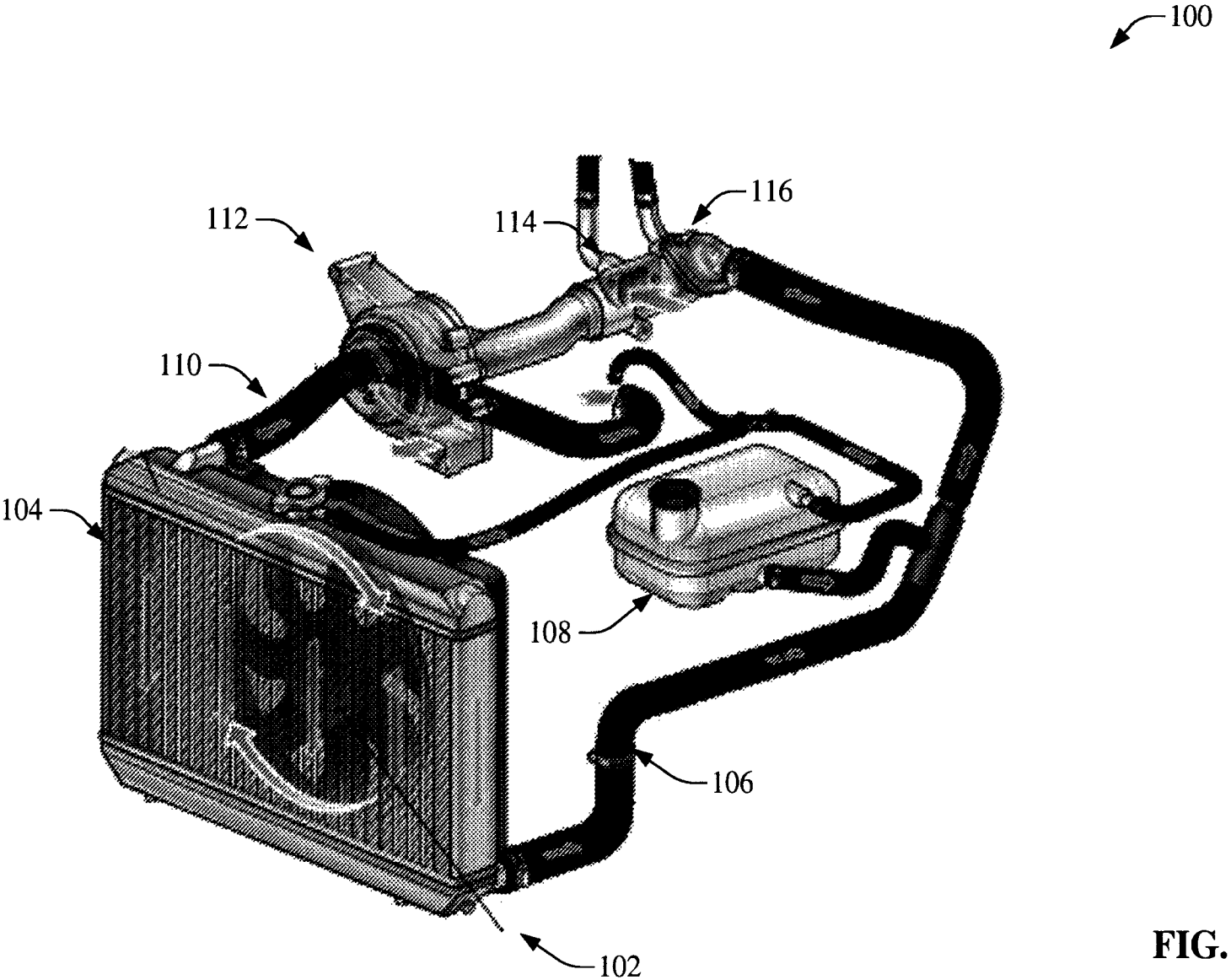
FIG. 1 illustrates a diagram of a typical radiator and associated components in accordance with one or more embodiments described herein.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of one or more embodiments. It is evident, however, in various cases, that one or more embodiments can be practiced without these specific details.

A radiator is a heat exchanger that is typically used to remove heat from a fluid, usually a coolant, and transfer it to the surrounding air. In the context of a vehicle, a radiator is an essential component of the cooling system that helps to maintain the optimal operating temperature of the engine and other key vehicle components.

A typical vehicle radiator consists of a network of small tubes or channels that are surrounded by thin metal fins. The hot coolant from a vehicle system such as an engine, flows through these tubes, and as it passes through the fins, the heat is transferred from the coolant to the surrounding air. This process of heat exchange helps to cool the coolant, which is then circulated back to the engine to absorb more heat. Radiators are typically made of aluminum or copper, which are excellent heat conductors. They are also designed to be durable and resistant to corrosion and damage. The size and design of the radiator may vary depending on the vehicle type and the specific cooling requirements of the vehicle.

Vehicle radiators are typically designed to provide adequate cooling capacity for the engine and other cooling systems under normal operating conditions. However, in some cases, they may be underutilized or not operating at optimal efficiency. Underutilization or inefficiency can occur if the engine design, air flow, coolant flow, or radiator size are not properly optimized. The coolant flow rate can also affect cooling efficiency. By optimizing flow rate and direction of coolant, it can more effectively absorb heat from and transfer it to the radiator for dissipation. Proper sizing of the radiator is important for optimal cooling efficiency and to prevent damage to the engine.

A vehicle radiator functions on a continuous cycle that is designed to maintain optimal temperature for a system it is cooling. Heat is generated by a vehicle system; in the example of a combustion engine, heat is generated from the combustion of fuel or air. Coolant then absorbs heat. In the example of an engine, coolant flows through the engine block and absorbs heat from engine components; this helps to regulate engine temperature and prevent overheating. The hot coolant now flows out of the engine and into the radiator. As it flows through the radiator tubes, the heat is dissipated to the surrounding air, which cools the coolant. The cooled coolant flows back to the engine through a hose or pipe. As it flows back into the engine block, it absorbs more heat, and the process cycle continues. In some cases, a fan may be used to help dissipate heat from the radiator. The fan pulls air through the radiator fins, which helps to increase the cooling efficiency of the radiator. A thermostat is typically used to regulate the temperature of the coolant. If the engine temperature becomes too high, a valve will open, allowing more coolant to flow through the radiator and dissipate more heat.

The number of radiators a vehicle has can vary depending on the make and model of the vehicle, as well as its cooling requirements. Most passenger cars have a single radiator, which is typically located at the front of the vehicle behind the grille. Larger trucks and SUVs may have multiple radiators, depending on their towing capacity and engine size. Some may have a main radiator at the front of the vehicle and an auxiliary radiator at the rear, or multiple radiators to cool different engine components. Performance vehicles, such as sports cars, may have multiple radiators to handle the increased heat load from a high-performance engine. Some may have a separate radiator for the engine oil, transmission fluid, or other components. Hybrid and electric vehicles may have a separate radiator to cool the battery pack, in addition to the main radiator for the engine and other components. In general, most vehicles have a single radiator, but larger or more complex vehicles may require multiple radiators to handle the increased heat load.

As previously mentioned, the water/coolant cooling system of vehicles often use two or more radiators to cool more than one coolant cooling system. The radiators can be arranged in layers or in stacks. This often mean that either you lose air flow or temperature leverage in the systems when one of the systems is running on full power and the other system requires less cooling power. This invention provides a shared controllable radiator for two separate cooling systems that is capable of distributing more cooling power to the system with the highest cooling needs with less system losses. This also opens up the capability for cooling at two different temperature levels for the two cooling systems, allowing one system to run hotter than the other which is good for efficiency. An aspect of one or more embodiments is an ability to control radiator surface area in real time to counter temperature increases, as it behaves as a heat sink, to address cooling requirements for each circuit. Each cooling circuit can be allotted a certain amount of radiator surface space, this space can increase or decrease as temperature fluctuates.

FIG. 1 illustrates a diagram of a typical radiator and associated components in accordance with one or more embodiments described herein;

Radiator 104 is a component of the cooling system 100. It is typically located at the front of the vehicle and is responsible for removing heat from coolant. Surface area of a radiator plays a role in the cooling process by increasing rate of heat transfer from hot coolant to cooler ambient air. This is achieved through a process of convection, where heat is transferred from one surface to another by movement of fluid. The radiator is typically made up of a series of thin metal tubes or fins that are arranged in a grid-like pattern. The coolant flows through these tubes, which are surrounded by a large number of fins. The surface area of these fins is part of the cooling process because it allows more air to come into contact with the hot coolant and absorb its heat. As the hot coolant flows through the tubes, it heats up the metal fins by conduction. The fins then transfer this heat to the surrounding air by convection. The greater the surface area of the radiator, the more metal fins are exposed to the air, and the greater the amount of heat that can be dissipated from the coolant. The design of the radiator, including the size and shape of the tubes and fins, is also important for maximizing the surface area and promoting efficient heat transfer. Some radiators may include additional features, such as louvers or deflectors, that help to direct the flow of air over the fins and increase the cooling efficiency. Overall, the surface area of a radiator is a primary factor in the effectiveness of a vehicle's cooling system. By increasing the surface area of the radiator, more heat can be dissipated from the coolant, helping to prevent the engine from overheating and ensuring that the vehicle operates efficiently and reliably.

Coolant (which would travel in hoses 106 & 110) is a mixture of water and antifreeze that circulates through an engine and a radiator. It absorbs heat from an engine and carries it to a radiator for dissipation.

Water pump 112 circulates coolant through the engine and radiator. It is driven by the engine's crankshaft through a belt or a chain. Thermostat 116 regulates flow of coolant through the engine and radiator. It stays closed until the engine reaches a predetermined temperature, then it opens to allow coolant to flow through the radiator. Radiator fan 102 helps to increase airflow through a radiator when the vehicle is not moving fast enough to provide sufficient cooling. Some vehicles have electric fans, while others have mechanical fans that are driven by the engine. Hoses 110 and 106 carry the coolant from the engine to the radiator and back. They are usually made of rubber and can become brittle over time, leading to leaks.

A 3-way valve 114 in a radiator cooling system is typically used in a system that has a secondary coolant loop, such as a hybrid or electric vehicle, or a system that has a separate heating loop for the passenger compartment. The function of the 3-way valve is to control the flow of coolant between the primary and secondary loops, or between the heating and cooling loops. The valve can also be used to simply recirculate the coolant back into a circuit when cooling by a radiator is not required. A 3-way valve may be controlled manually or automatically by an engine control module (ECM—not depicted in this diagram) or a separate processor control unit, not depicted in this diagram, based on the temperature of the coolant and other factors. By controlling flow of coolant between the primary and secondary loops, a 3-way valve helps to optimize efficiency of the cooling system and the overall operation of the vehicle. Overall, these components work together to regulate the temperature of the engine and prevent it from overheating, which can cause damage to the engine.

Expansion tank 108, also known as a coolant reservoir, is also a component of a radiator cooling system. A function is to allow for expansion and contraction of the coolant as it heats up and cools down during normal engine operation. As the engine heats up, the coolant in the system expands and pressure inside the cooling system increases. The expansion tank provides a space for this extra coolant to go, preventing it from overflowing or creating excess pressure that could damage the radiator or other components. Similarly, as the engine cools down and the coolant contracts, the expansion tank allows for the coolant to be drawn back into the cooling system as needed. This helps to ensure that the cooling system remains at the proper level and that there is always enough coolant to protect the engine from overheating. The expansion tank typically has a line that connects it to the radiator, allowing coolant to flow back and forth between the two as required. Some expansion tanks also include a pressure relief valve, which helps to prevent excess pressure from building up in the cooling system. In addition to its primary function of managing coolant expansion and contraction, an expansion tank may also include a level sensor (not depicted in this diagram) that provides feedback to the vehicle's computer (not depicted in this diagram) about the coolant level in the system. This can help to alert a driver if there is a problem with the cooling system, such as a leak or a low coolant level. Overall, the expansion tank plays a major role in maintaining the proper coolant level and pressure in a radiator cooling system, helping to prevent engine overheating and damage.

Figure 2:
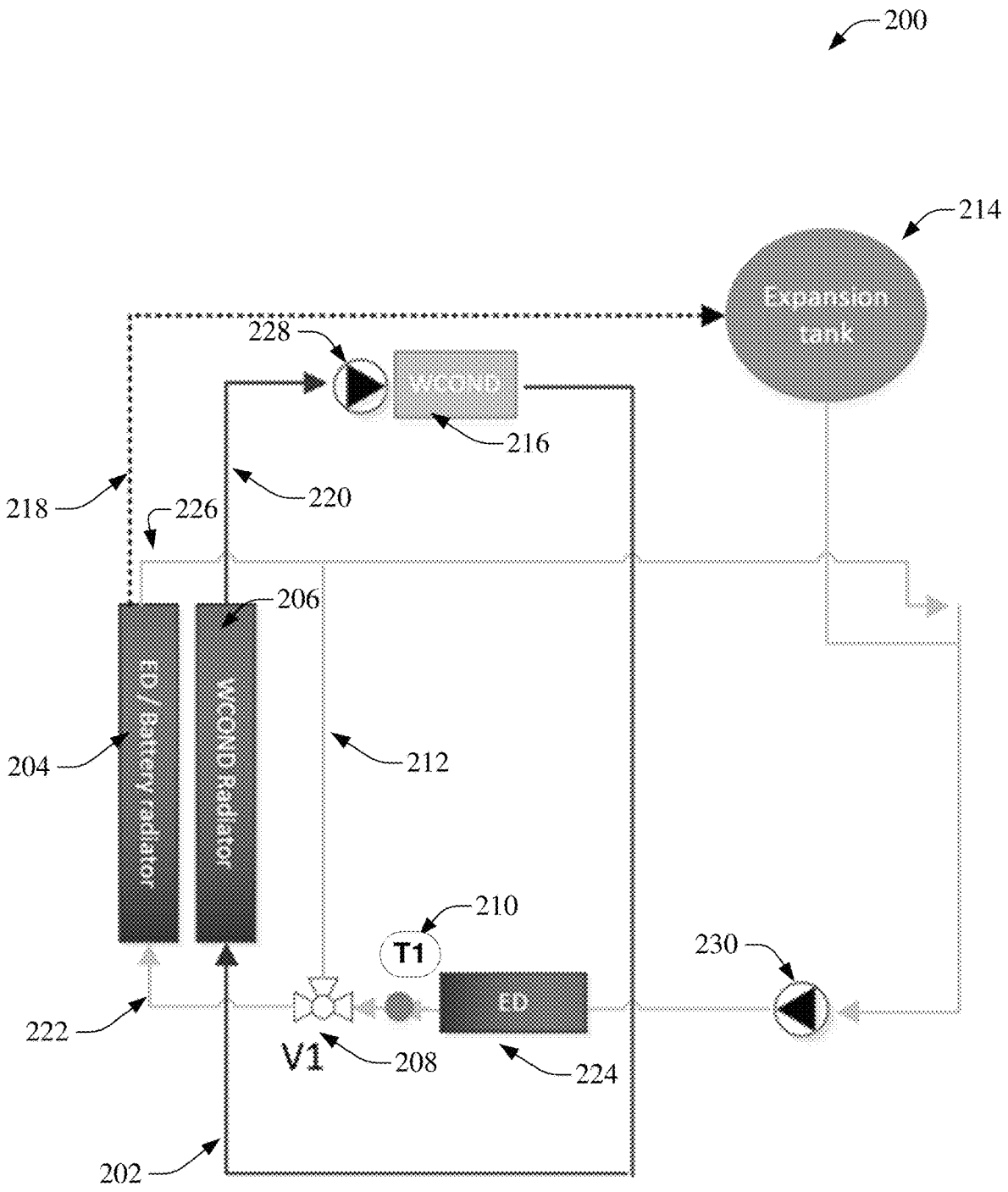
FIG. 2 illustrates a basic two radiator system schematic in accordance with one or more embodiments described herein.

FIG. 2 illustrates a basic two radiator system schematic in accordance with one or more embodiments described herein. The systems shown on 200 are both cooling circuits that are connected to their own respective radiator. Each system is comprised of a closed loop representing a continuous cycle of coolant flow. The two example systems pictured include pump 228, pump 230, "WCOND" 216 which is an Air Conditioning System, and "ED" an Electric Drive system 224, each of which has a dedicated radiator. In the case of ED, coolant flows into the system at a cooler temperature and leaves at a higher temperature. After leaving the ED system, coolant passes through a temperature sensor depicted by T1 (210). A determination is made based on temperature along with other possible criteria and one of two actions is taken, the coolant is either recirculated back to the ED 212 pathway via the 3 way valve V1 (208), or if cooling is required, passed to the radiator 204 via the 3 way valve V1 (208), through the path 222 then enters the radiator 204 hot. Inside the radiator 204, the coolant flows through a network of small tubes or channels surrounded by thin metal fins. As the coolant passes through the radiator, heat is transferred to the surrounding. This heat transfer allows the coolant to leave radiator 204 and flow through path 226 at a cooled, or lower temperature before it is circulated back to the ED to absorb more heat. Any overflow can be sent to path 218 and flow to an expansion tank 214. "WCOND" 216 circuit does not contain a temperature sensor or a valve, so the circuit flow as hot fluid comes into the WCOND radiator 206 using input line 202. The fluid can exit radiator 206 at a lower temperature then its entrance temperature using output line 220. This diagram is to depict how two physical radiators can support two different cooling systems.

Figure 3:
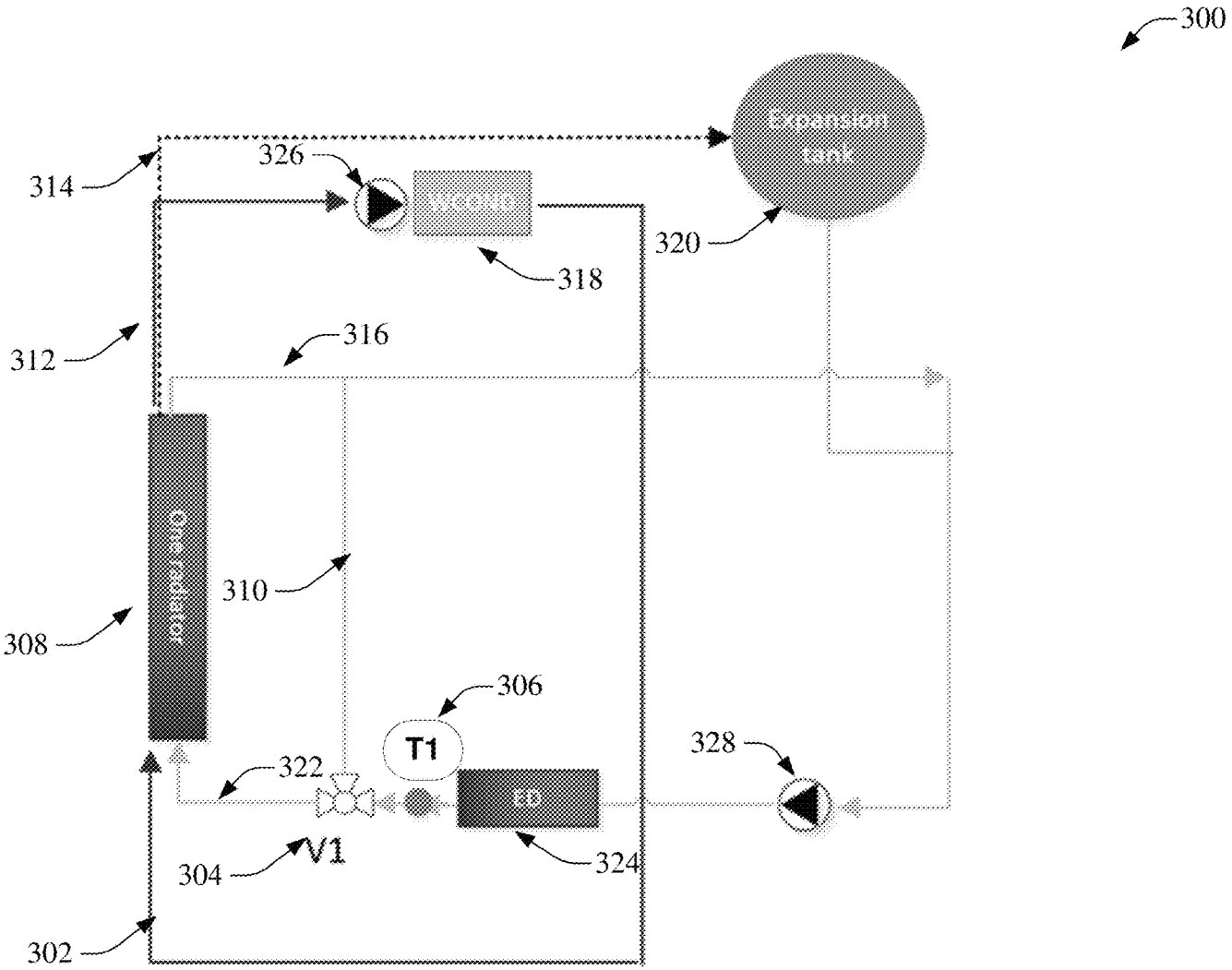
FIG. 3 illustrates a single radiator system schematic connected to two separate cooling circuits, one circuit is passively controlled, and another circuit is actively controlled, in accordance with one or more embodiments described herein.

FIG. 3 illustrates a single radiator system schematic connected to two separate cooling circuits, one circuit is passively controlled, and the other circuit is actively controlled, in accordance with one or more embodiments described herein. The systems shown on 300 are two cooling circuits that are connected to one radiator. This schematic depicts the same two cooling systems in FIG. 2, but now using the innovation to control fluid temperature with only one radiator. The primary difference between FIG. 2 and FIG. 3 is that a radiator is partitioned into two separate sections (this will be detailed in FIG. 5), with one circuit connected to one partition and the second circuit connected to the second partition. The diagram does not show the partitions. The flow is essentially the same as FIG. 2, each system or circuit is comprised of a closed loop representing a continuous cycle of coolant flow. The two example systems pictured include pump 326, pump 328, "WCOND" 318 which is an Air Conditioning System, and "ED" an Electric Drive system 324, each employing the same physical radiator for cooling. In the case of ED, coolant flows into the system at a cooler temperature and leaves at a higher temperature. After leaving the ED system 324, the coolant passes through a temperature sensor depicted by T1 (306). A determination is made based on temperature along with other possible criteria and one of two actions is taken, the coolant is either recirculated back to the ED path 310 via the 3-way valve V1 (304), or if needed through the path 322 where it enters the radiator 308 hot. Inside the radiator, the coolant flows through a network of small tubes or channels surrounded by thing metal fins. This radiator is separated into two partitions and the fluid will travel through the dedicated partitioned surface area allotted for that circuit. As the coolant passes through the radiator, the heat is transferred to the surrounding. The surface area of the radiator that can be dedicated to this system can be based on the current temperature at T1 (306) and the method of varying the surface area will be further described in FIG. 5. This heat transfer allows the coolant to leave the radiator 308 using path 316 at a cooled, or lower, temperature before it is circulated back to the ED 324 to absorb more heat. Any overflow can use path 314 and is sent to expansion tank 320. The "WCOND" 318 circuit does not contain a temperature sensor or a valve so the circuit flows with fluid coming into the WCOND radiator 308 using input line 302 (this can be referred to as passive control as there is no temperature sensor or valve to guide any type of controller to manipulate radiator surface area). The fluid will travel through a dedicated WCOND partitioned surface area of the radiator and exit the radiator 308 at a lower temperature then its entrance temperature using output line 312. This diagram is to depict how one physical radiator can support two different cooling systems. Since only the ED 324 circuit has a valve 304 and a temperature sensor 306, this is the only circuit that cooling can be actively controlled by a process controller (not depicted on this diagram), the controller can dictate the amount of radiator surface area that can be used to cool this circuit by driving an actuator, that in turn can manipulate a screw which can push and pull a plunger that increases or decreases radiator surface based on active process control. The second circuit can utilize the remaining surface area, in this case the second circuit is an air conditioning system so it is not typically under very high temperature.

Figure 4:
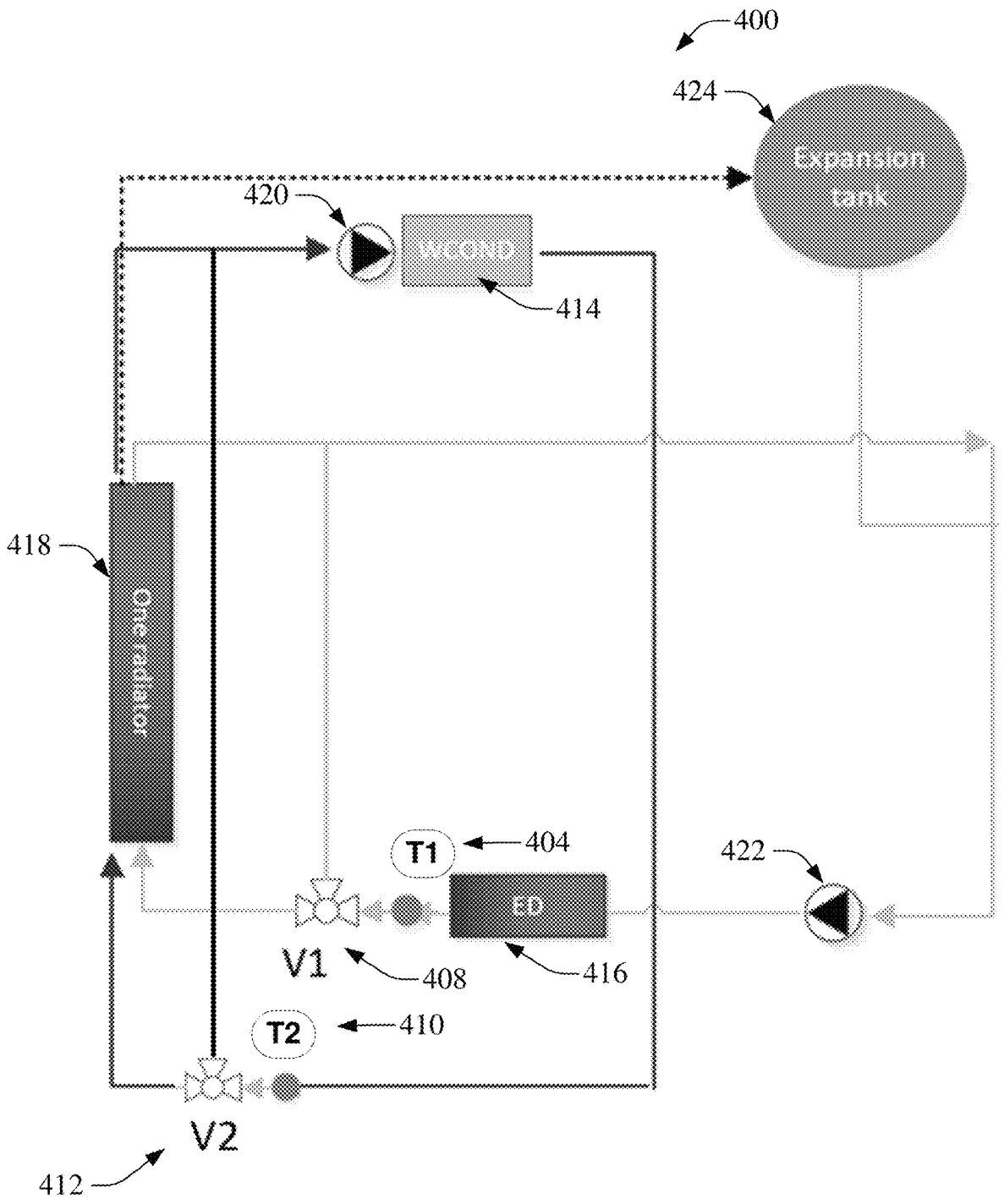
FIG. 4 illustrates a single radiator system schematic connected to two separate cooling circuits with both circuits actively controlled, in accordance with one or more embodiments described herein.

FIG. 4 illustrates a single radiator system schematic connected to two separate cooling circuits with both circuits actively controlled, in accordance with one or more embodiments described herein. The systems shown on 400 are two cooling circuits that are connected to one radiator 418. This circuit is the exact same circuit as in FIG. 3, except a temperature sensor 410 and a 3-way valve 410 has been added to the WCOND 414 circuit (this can be any vehicle circuit, not just an AC circuit). The novelty of this innovation provides options such as the ability to actively control both circuits (WCOND 414 & ED 416) with a one radiator. In this design, a control processor (not depicted on this diagram) can make decisions on radiator surface usage based on temperature readings from both sensors (404 & 410), one for each circuit. Each temperature sensor, T1 (404) for the ED 416 circuit and T2 (410) for the WCOND 414 circuit can send real time temperature data to a process controller, the processor can utilize given criteria, specifications and other possible data to manipulate a plunger (to be described in FIG. 5), to increase or decrease radiator surface areas for each circuit. Since increasing one circuit's radiator surface area results in the decrease of the second circuit's radiator surface area, various algorithms and fine tuning may be involved in optimizing the cooling process for each system. The 3-way valves, both V1 (408) and V2 (412) can be operated employing fluid temperature directly as a method to open and close fractionally or another type of method such as being directly controlled by a processor. Pump 420, pump 422, and expansion tank 424 are also depicted.

Figure 5:
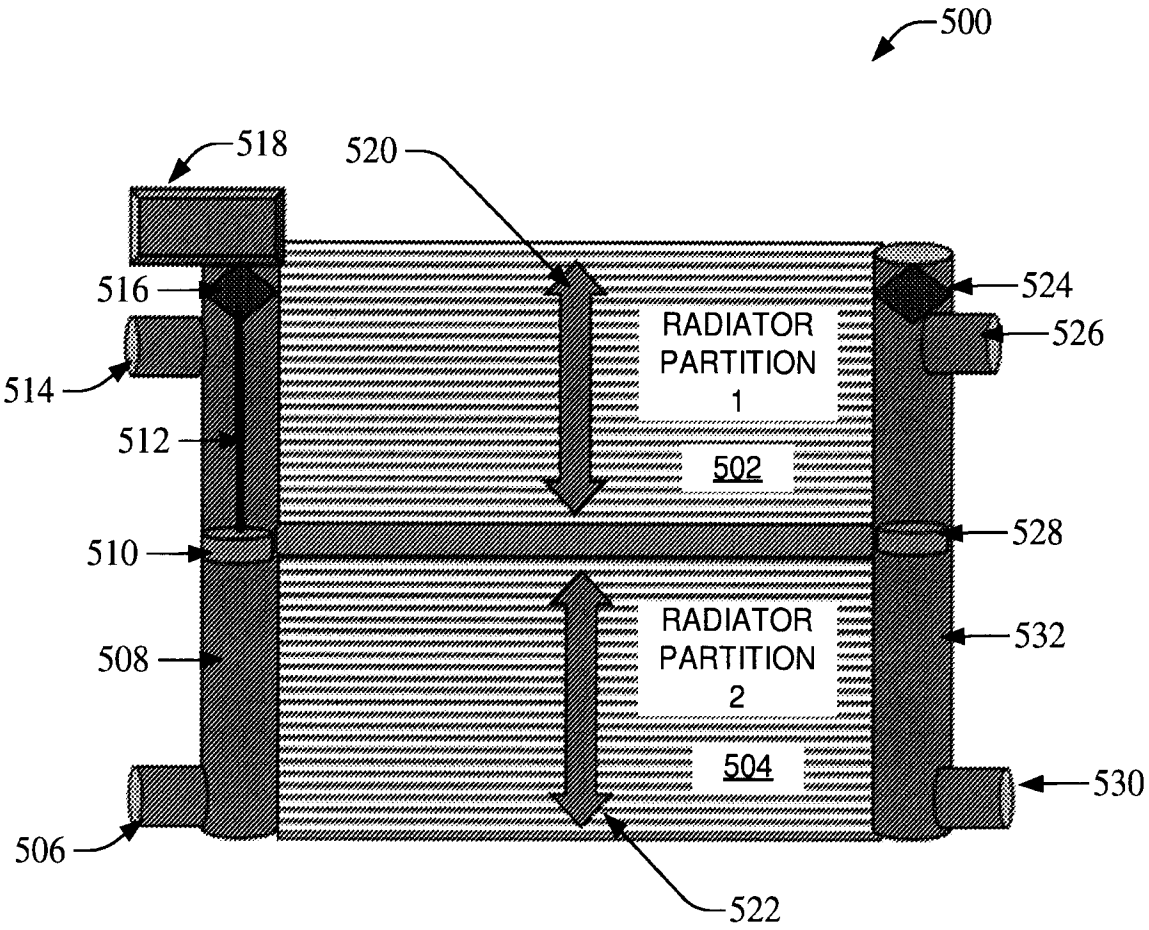
FIG. 5 illustrates the architecture and components of a single radiator capable of actively controlling two separate cooling systems, in accordance with one or more embodiments described herein.

FIG. 5 illustrates the architecture and components of a single radiator capable of actively controlling two separate cooling systems, in accordance with one or more embodiments described herein. The radiator (depicted here as the entire unit 500) is a physical unit partitioned into two separate surface areas (502 & 504) using a set of plungers (510 & 528) and possibly a plate or a type of separating device connected to a set of plungers (510 & 528). In this diagram, each partitioned area is labeled, Radiator Partition 1 (502) which represents the surface area range covered by arrow 520 and is dedicated to one of the two circuits and Radiator Partition 2 (504) which represents the surface area range covered by arrow 522 and is dedicated to the second of the two circuits connected. The separation point of the two surface areas is the location of the plunger set (510 & 528). From this example, each circuit has approximately the same amount of dedicated radiator surface area. There is an actuator 518 on the top left of the radiator which can be controlled by some type of a processor unit (not depicted in this diagram). Actuators can be controlled through various methods depending on their type and the intended application. Here are some common ways to control actuators:

Electrical signals: Some actuators, such as electric motors, solenoids, and electromagnets, are controlled through electrical signals. The signal can be a simple on/off switch or a more complex signal such as a PWM (Pulse Width Modulation) signal to control the speed or position of the actuator.

Pneumatic or hydraulic signals: Pneumatic or hydraulic actuators are controlled through compressed air or fluid signals. The signal can be controlled by manual valves, automatic control valves, or digital controllers.

Mechanical control: Some actuators, such as servomotors, can be controlled mechanically through gears, cams, and linkages.

Programmable logic controllers (PLCs): A PLC is a digital computer that can be programmed to control various actuators and sensors in a system. PLCs are commonly used in industrial control systems.

Microcontrollers: Microcontrollers can also be used to control actuators, especially in smaller, simpler systems. Microcontrollers can be programmed to respond to various inputs and control the actuator output accordingly.

As the temperature fluctuates in each circuit, sensors such as (404 & 410) can provide data to the process controller and based on this data along with other possible criteria, the controller can adjust the actuator to optimize cooling in each circuit. The actuator 518 can control a set of screws (516 & 524) and the set of screws (516 & 524) can push or pull the set of plungers (510 & 528) by a connection 512 it has with the plunger set (510 & 528). This diagram shows the principal design of the invention. The tanks of the radiator (508 for the input tank and 532 for the outlet tank) are designed as straight tubes with a set of screws (516 & 524) and a set of plungers (510 & 528) in each tank (508 & 532). The screws can be synchronized with a gear and shaft mechanism or cog belt. The actuator 518 can run the set of screws (516 & 524) which can pull or push the plungers (510 & 528) up and down in the tanks. As the plungers 510 & 528 move up or down, the surface area sectioned off by them also moves up and down correspondingly, which increases or decreases the surface area for each circuit. The tanks are connected to the two cooling systems with the four spigots on the tanks. For radiator partition 1, the fluid enters through spigot 514, then passes through the radiator core surface area of partition 1 (502) and exits through spigot 526. For radiator partition 2, the fluid enters through spigot 506, then passes through the radiator core surface area of partition 2 (504) and exits through spigot 530. As the fluid enters and then exits, it can be cooled based on the amount of surface area it travels through. The invention allows control of the cooling by moving the plunger up and down, regulating the surface area and therefore the cooling capability. More or less of the finned tube core of the radiator between the tanks is connected to each of the cooling systems as the actuator elevates or lower the plungers.

Figure 6:
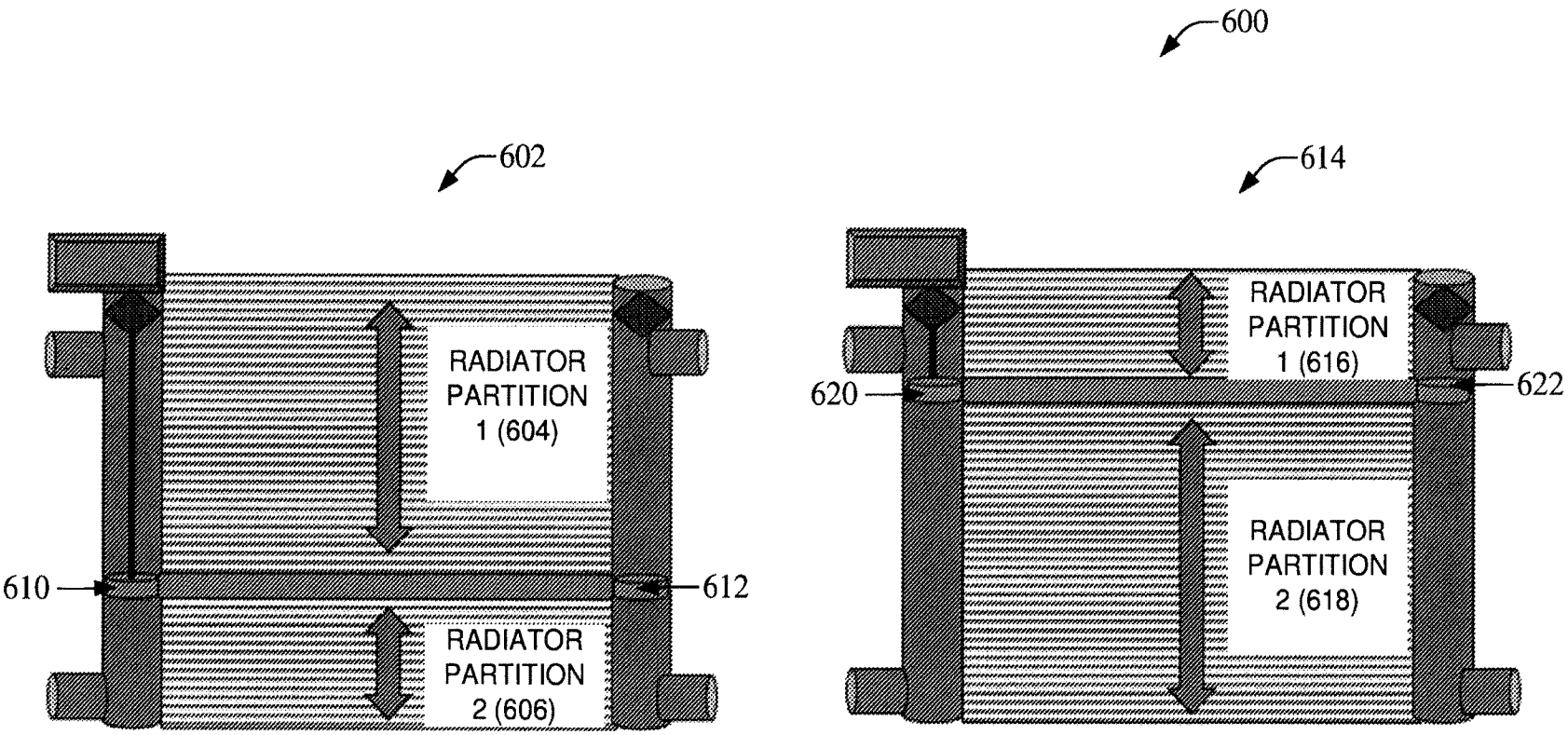
FIG. 6 illustrates the partitioning of radiator surface areas to control cooling based on plunger activity for each circuit, in accordance with one or more embodiments described herein.

FIG. 6 illustrates the partitioning of radiator surface areas to control cooling based on plunger activity for each circuit, in accordance with one or more embodiments described herein. The two radiators shown on 600 depict how the surface area can vary for each circuit based on cooling needs. The example radiator 602 reflects a cooling circuit (connected to Partition 1 604) that is dealing with high temperatures that should be reduced quickly and a second cooling circuit (connected to partition 2 606) that is dealing with moderate or cooler temperatures. The plunger set (610 & 612) has been pushed down significantly by system controls, so the vast amount of cooling fluid is traveling through the large surface area in partition 1 604. As the temperature decreases, the plunger may be moved back up to reduce surface area based on the system requirements and specifications. The example radiator 614 reflects the second cooling circuit having high temperatures, in this case the plunger set (620 & 622) has been pulled up allowing greater surface area partition 2 618 for the fluid to travel through. If both circuits are dealing with high temperatures, system specifications and operational guidelines can dictate plunger activity.

Figure 7:
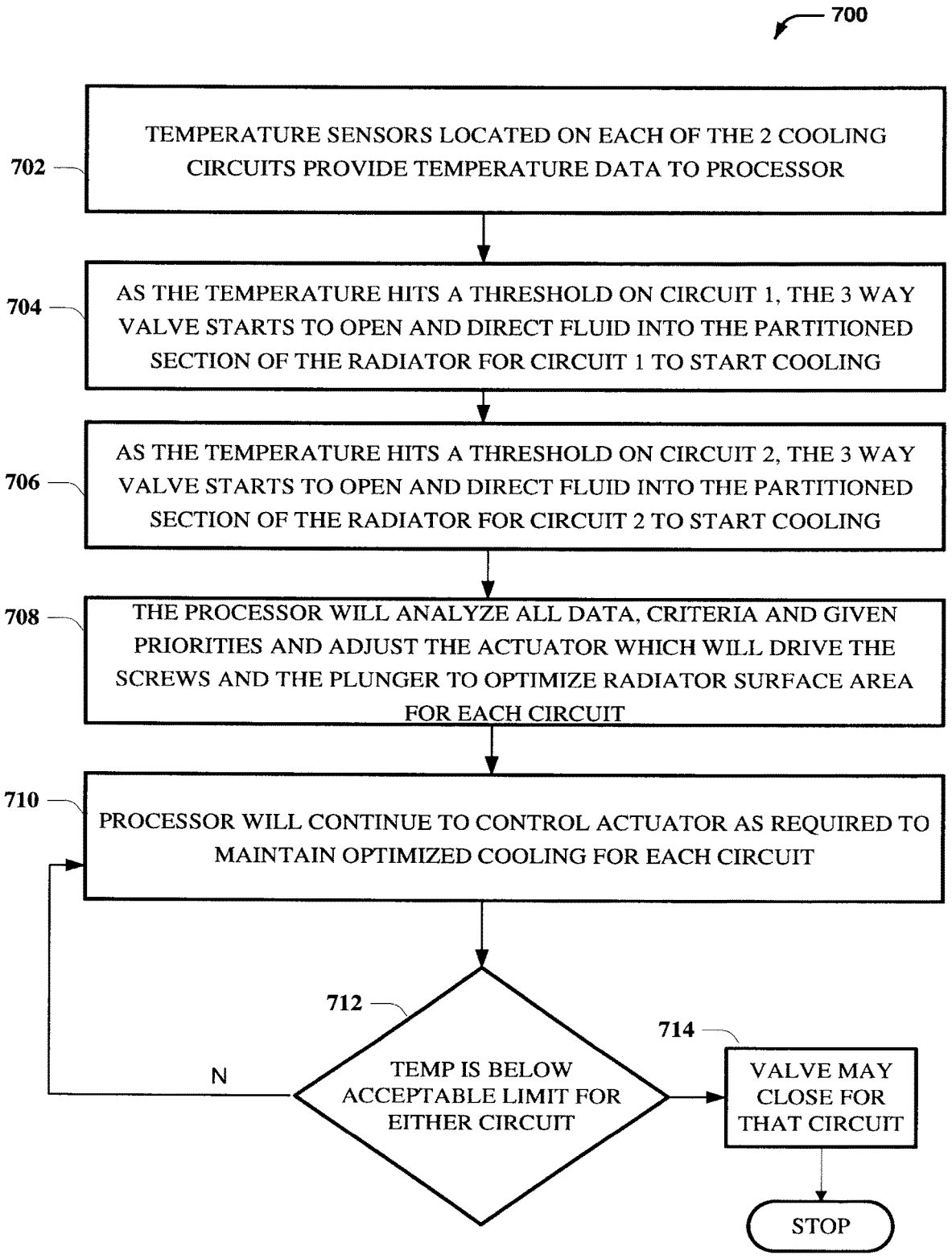
FIG. 7 illustrates a flow chart diagram in accordance with one or more embodiments described herein.

FIG. 7 illustrates a flow chart diagram in accordance with one or more embodiments described herein. Temperature sensors can provide digital or analog data to a processor that can control the cooling system for two separate circuits (702). As the temperature increases to or above a certain threshold on one of the circuits, the 3 way valve can open by internal method or by processor control 704. The valve for that circuit can open and allow a certain amount of fluid to flow through that respective radiator partition. As the temperature increases to or above a certain threshold on the second circuit, the 3 way valve can open by internal method or by processor control 704. The valve for that second circuit can open and allow a certain amount of fluid to flow through that respective radiator partition 706. If one of the circuits does not have a valve and a temperature sensor, the surface area dedicated to the circuit can be based on what surface area is remaining after the other circuit's cooling needs are met. The processor can analyze various types of data relating to the cooling circuit and can increase the radiator surface area of a specific circuit via the actuator, screw and plunger mechanism 708. The processor can continue to monitor 710 each circuits data and adjust each partitioned area based on each circuit's cooling needs. As this process continues, system configuration can determine the behavior of ongoing control, as a certain temperature decrease 712 in a circuit can lead to closure of a valve 714 in a circuit and also reduction of radiator surface area. This does not have to be the case as there are many possible control parameters that can be used to continue optimizing each circuit's cooling needs. There may be AI or machine learning that is employed to maintain an optimum temperature for each circuit.

Figure 8:
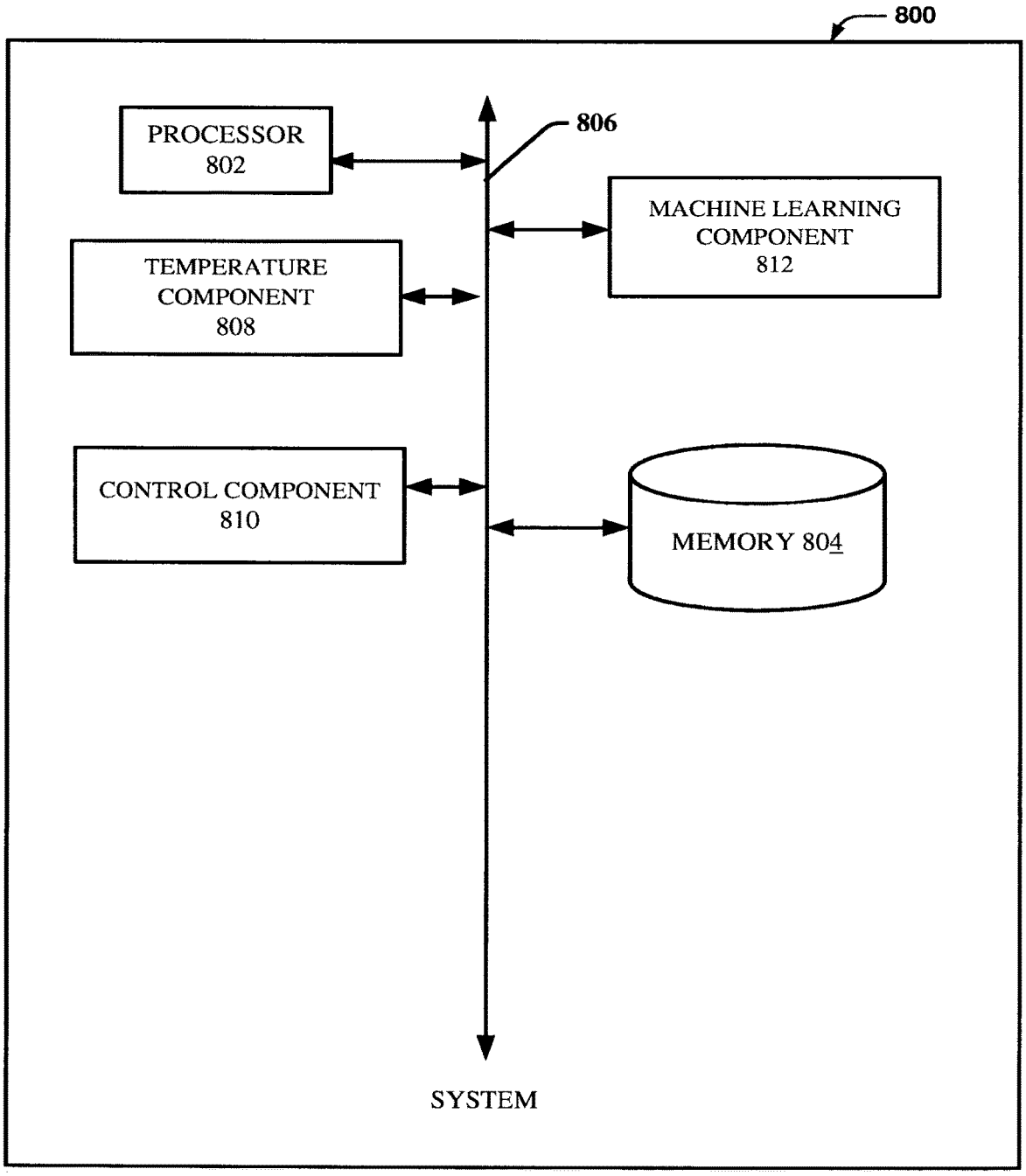
FIG. 8 depicts a basic block diagram of the major components of the architecture which the disclosed subject matter can interact/be implemented at least in part, in accordance with various aspects and implementations of the subject disclosure.

FIG. 8 depicts a basic block diagram of the major components of an architecture which the disclosed subject matter can interact/be implemented at least in part, in accordance with various aspects and implementations of the subject disclosure. System 800 can be depicted as a controlling unit for the cooling circuits mentioned in this innovation. A processor 802 operatively connected to memory 804 can monitor signals provided from temperature sensors 808 connected to each cooling circuit. These signals may be driven via analog or digital methods and can provide temperature readings in a real time deterministic format. A processor 802 can utilize various methods to control component 810 that drives an actuator which connected to a screw and plunger mechanism can regulate radiator surface area for each circuit. An AI or machine learning component 812 may also interact with the system and can learn trends and patterns over time and predict possible temperature spikes before they occur to optimize system performance. A machine learning algorithm can analyze past data and start employing a machine created schedule for plunger movement to avoid rapid changes in temperature which can lead to a smooth temperature curve throughout its run cycles.

Figure 9:
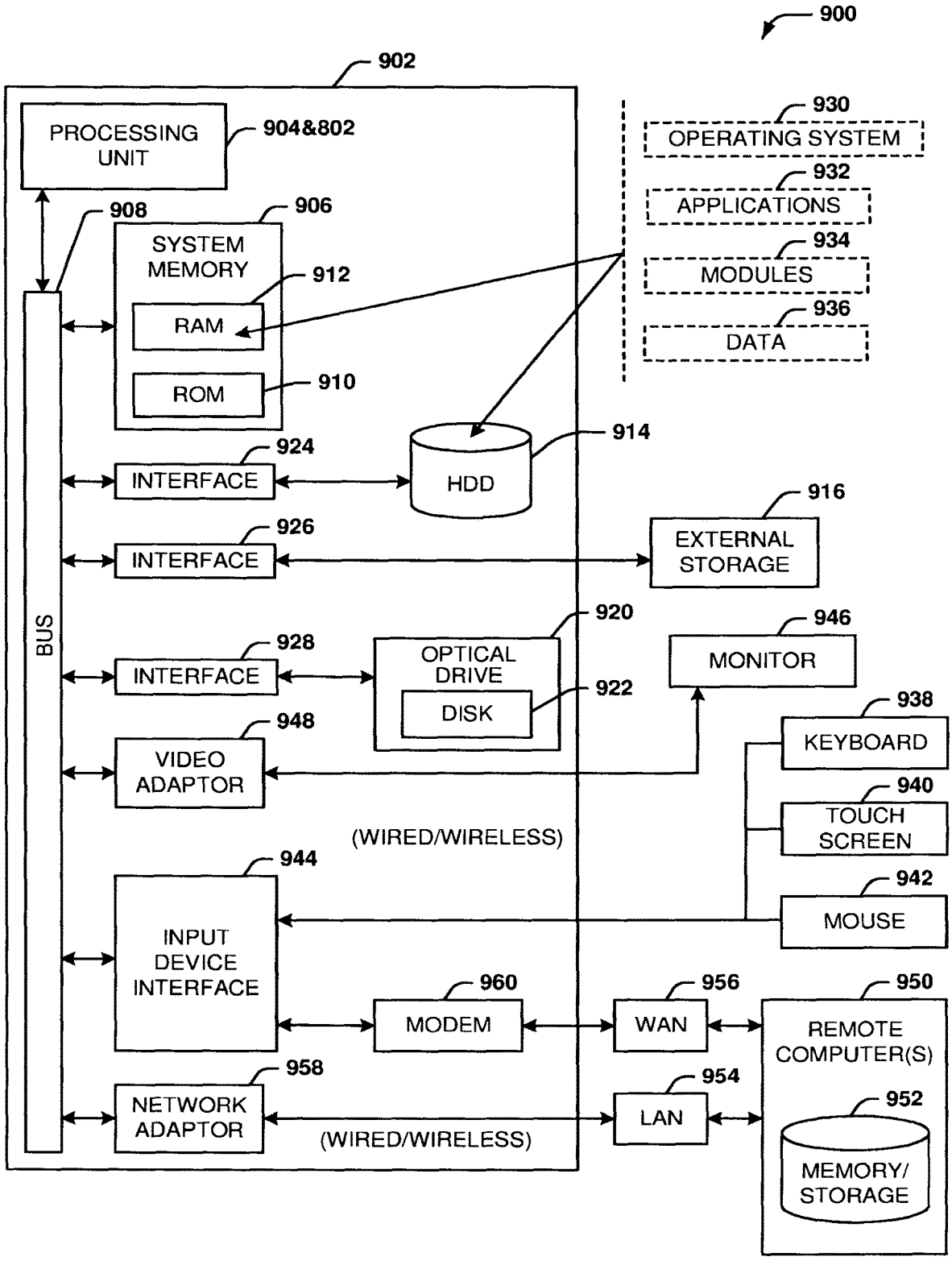
FIG. 9 depicts an example schematic block diagram 900 of a computing environment with which the disclosed subject matter can interact/be implemented at least in part, in accordance with various aspects and implementations of the subject disclosure.

FIG. 9 depicts an example schematic block diagram 900 of a computing environment with which the disclosed subject matter can interact/be implemented at least in part, in accordance with various aspects and implementations of the subject disclosure. The example environment 900 for implementing various embodiments of the aspects described herein includes a computer 902, the computer 902 including a processing unit 904, a system memory 906 and a system bus 908. The system bus 908 couples system components including, but not limited to, the system memory 906 to the processing unit 904. The processing unit 904 can be any of various commercially available processors and may include a cache memory. Dual microprocessors and other multiprocessor architectures can also be employed as the processing unit 904.

The system bus 908 can be any of several types of bus structure that can further interconnect to a memory bus (with or without a memory controller), a peripheral bus, and a local bus using any of a variety of commercially available bus architectures. The system memory 906 includes ROM 910 and RAM 912. A basic input/output system (BIOS) can be stored in a nonvolatile memory such as ROM, erasable programmable read only memory (EPROM), EEPROM, which BIOS contains the basic routines that help to transfer information between elements within the computer 902, such as during startup. The RAM 912 can also include a high-speed RAM such as static RAM for caching data.

The computer 902 further includes an internal hard disk drive (HDD) 914 (e.g., EIDE, SATA), one or more external storage devices 916 (e.g., a magnetic floppy disk drive (FDD) 916, a memory stick or flash drive reader, a memory card reader, etc.) and an optical disk drive 920 (e.g., which can read or write from a CD-ROM disc, a DVD, a BD, etc.). While the internal HDD 914 is illustrated as located within the computer 902, the internal HDD 914 can also be configured for external use in a suitable chassis (not shown). Additionally, while not shown in environment 900, a solid-state drive (SSD) could be used in addition to, or in place of, an HDD 914. The HDD 1314, external storage device(s) 916 and optical disk drive 920 can be connected to the system bus 908 by an HDD interface 924, an external storage interface 926 and an optical drive interface 928, respectively. The interface 924 for external drive implementations can include at least one or both of Universal Serial Bus (USB) and Institute of Electrical and Electronics Engineers (IEEE) 1394 interface technologies. Other external drive connection technologies are within contemplation of the embodiments described herein.

The drives and their associated computer-readable storage media provide nonvolatile storage of data, data structures, computer-executable instructions, and so forth. For the computer 902, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 912, including an operating system 930, one or more application programs 932, other program modules 934 and program data 936. All or portions of the operating system, applications, modules, and/or data can also be cached in the RAM 912. The systems and methods described herein can be implemented utilizing various commercially available operating systems or combinations of operating systems.

Computer 902 can optionally comprise emulation technologies. For example, a hypervisor (not shown) or other intermediary can emulate a hardware environment for operating system 930, and the emulated hardware can optionally be different from the hardware illustrated in FIG. 8. In such an embodiment, operating system 930 can comprise one virtual machine (VM) of multiple VMs hosted at computer 902. Furthermore, operating system 930 can provide runtime environments, such as the Java runtime environment or the .NET framework, for applications 932. Runtime environments are consistent execution environments that allow applications 932 to run on any operating system that includes the runtime environment. Similarly, operating system 930 can support containers, and applications 932 can be in the form of containers, which are lightweight, standalone, executable packages of software that include, e.g., code, runtime, system tools, system libraries and settings for an application.

Further, computer 902 can comprise a security module, such as a trusted processing module (TPM). For instance with a TPM, boot components hash next in time boot components, and wait for a match of results to secured values, before loading a next boot component. This process can take place at any layer in the code execution stack of computer 902, e.g., applied at the application execution level or at the operating system (OS) kernel level, thereby enabling security at any level of code execution.

A user can enter commands and information into the computer 902 through one or more wired/wireless input devices, e.g., a keyboard 938, a touch screen 940, and a pointing device, such as a mouse 942. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 904 through an input device interface 944 that can be coupled to the system bus 908, but can be connected by other interfaces, such as a parallel port, an IEEE 1394 serial port, a game port, a USB port, an IR interface, a BLUETOOTH® interface, etc.

A monitor 946 or other type of display device can be also connected to the system bus 908 via an interface, such as a video adapter 948. In addition to the monitor 946, a computer typically includes other peripheral output devices (not shown), such as speakers, printers, etc.

The computer 902 can operate in a networked environment using logical connections via wired and/or wireless communications to one or more remote computers, such as a remote computer(s) 950. The remote computer(s) 950 can be a workstation, a server computer, a router, a personal computer, portable computer, microprocessor-based entertainment appliance, a peer device or other common network node, and typically includes many or all of the elements described relative to the computer 902, although, for purposes of brevity, only a memory/storage device 952 is illustrated. The logical connections depicted include wired/wireless connectivity to a local area network (LAN) 954 and/or larger networks, e.g., a wide area network (WAN) 956. Such LAN and WAN networking environments are commonplace in offices and companies, and facilitate enterprise-wide computer networks, such as intranets, all of which can connect to a global communications network, e.g., the internet.

When used in a LAN networking environment, the computer 902 can be connected to the local network 954 through a wired and/or wireless communication network interface or adapter 958. The adapter 958 can facilitate wired or wireless communication to the LAN 954, which can also include a wireless access point (AP) disposed thereon for communicating with the adapter 958 in a wireless mode.

When used in a WAN networking environment, the computer 902 can include a modem 960 or can be connected to a communications server on the WAN 956 via other means for establishing communications over the WAN 956, such as by way of the internet. The modem 960, which can be internal or external and a wired or wireless device, can be connected to the system bus 908 via the input device interface 944. In a networked environment, program modules depicted relative to the computer 902 or portions thereof, can be stored in the remote memory/storage device 952. It will be appreciated that the network connections shown are example and other means of establishing a communications link between the computers can be used.

When used in either a LAN or WAN networking environment, the computer 902 can access cloud storage systems or other network-based storage systems in addition to, or in place of, external storage devices 916 as described above. Generally, a connection between the computer 902 and a cloud storage system can be established over a LAN 954 or WAN 956 e.g., by the adapter 958 or modem 960, respectively. Upon connecting the computer 902 to an associated cloud storage system, the external storage interface 926 can, with the aid of the adapter 958 and/or modem 960, manage storage provided by the cloud storage system as it would other types of external storage. For instance, the external storage interface 926 can be configured to provide access to cloud storage sources as if those sources were physically connected to the computer 902.

The computer 902 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and BLUETOOTH® wireless technologies. Thus, the communication can be a predefined structure as with a conventional network or simply an ad hoc communication between at least two devices.

The above description includes non-limiting examples of the various embodiments. It is, of course, not possible to describe every conceivable combination of components or methodologies for purposes of describing the disclosed subject matter, and one skilled in the art may recognize that further combinations and permutations of the various embodiments are possible. The disclosed subject matter is intended to embrace all such alterations, modifications, and variations that fall within the spirit and scope of the appended claims.

With regard to the various functions performed by the above described components, devices, circuits, systems, etc., the terms (including a reference to a "means") used to describe such components are intended to also include, unless otherwise indicated, any structure(s) which performs the specified function of the described component (e.g., a functional equivalent), even if not structurally equivalent to the disclosed structure. In addition, while a particular feature of the disclosed subject matter may have been disclosed with respect to only one of several implementations, such feature may be combined with one or more other features of the other implementations as may be desired and advantageous for any given or particular application.

The terms "exemplary" and/or "demonstrative" as used herein are intended to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent structures and techniques known to one skilled in the art. Furthermore, to the extent that the terms "includes," "has," "contains," and other similar words are used in either the detailed description or the claims, such terms are intended to be inclusive—in a manner similar to the term "comprising" as an open transition word-without precluding any additional or other elements.

The term "or" as used herein is intended to mean an inclusive "or" rather than an exclusive "or." For example, the phrase "A or B" is intended to include instances of A, B, and both A and B. Additionally, the articles "a" and "an" as used in this application and the appended claims should generally be construed to mean "one or more" unless either otherwise specified or clear from the context to be directed to a singular form.

The term "set" as employed herein excludes the empty set, i.e., the set with no elements therein. Thus, a "set" in the subject disclosure includes one or more elements or entities. Likewise, the term "group" as utilized herein refers to a collection of one or more entities.

The terms "first," "second," "third," and so forth, as used in the claims, unless otherwise clear by context, is for clarity only and doesn't otherwise indicate or imply any order in time. For instance, "a first determination," "a second determination," and "a third determination," does not indicate or imply that the first determination is to be made before the second determination, or vice versa, etc.

As used in this disclosure, in some embodiments, the terms "component," "system" and the like are intended to refer to, or comprise, a computer-related entity or an entity related to an operational apparatus with one or more specific functionalities, wherein the entity can be either hardware, a combination of hardware and software, software, or software in execution. As an example, a component can be, but is not limited to being, a process running on a processor, a processor, an object, an executable, a thread of execution, computer-executable instructions, a program, and/or a computer. By way of illustration and not limitation, both an application running on a server and the server can be a component.

One or more components can reside within a process and/or thread of execution and a component can be localized on one computer and/or distributed between two or more computers. In addition, these components can execute from various computer readable media having various data structures stored thereon. The components can communicate via local and/or remote processes such as in accordance with a signal having one or more data packets (e.g., data from one component interacting with another component in a local system, distributed system, and/or across a network such as the internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. While various components have been illustrated as separate components, it will be appreciated that multiple components can be implemented as a single component, or a single component can be implemented as multiple components, without departing from example embodiments.

The term "facilitate" as used herein is in the context of a system, device or component "facilitating" one or more actions or operations, in respect of the nature of complex computing environments in which multiple components and/or multiple devices can be involved in some computing operations. Non-limiting examples of actions that may or may not involve multiple components and/or multiple devices comprise transmitting or receiving data, establishing a connection between devices, determining intermediate results toward obtaining a result, etc. In this regard, a computing device or component can facilitate an operation by playing any part in accomplishing the operation. When operations of a component are described herein, it is thus to be understood that where the operations are described as facilitated by the component, the operations can be optionally completed with the cooperation of one or more other computing devices or components, such as, but not limited to, sensors, antennae, audio and/or visual output devices, other devices, etc.

Further, the various embodiments can be implemented as a method, apparatus or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable (or machine-readable) device or computer-readable (or machine-readable) storage/communications media. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

Moreover, terms such as "mobile device equipment," "mobile station," "mobile," "subscriber station," "access terminal," "terminal," "handset," "communication device," "mobile device" (and/or terms representing similar terminology) can refer to a wireless device utilized by a subscriber or mobile device of a wireless communication service to receive or convey data, control, voice, video, sound, gaming or substantially any data-stream or signaling-stream. The foregoing terms are utilized interchangeably herein and with reference to the related drawings. Likewise, the terms "access point (AP)," "Base Station (BS)," "BS transceiver," "BS device," "cell site," "cell site device," "gNode B (gNB)," "evolved Node B (eNode B, eNB)," "home Node B (HNB)" and the like, refer to wireless network components or appliances that transmit and/or receive data, control, voice, video, sound, gaming or substantially any data-stream or signaling-stream from one or more subscriber stations. Data and signaling streams can be packetized or frame-based flows.

Furthermore, the terms "device," "communication device," "mobile device," "subscriber," "client entity,"

"consumer," "client entity," "entity" and the like are employed interchangeably throughout, unless context warrants particular distinctions among the terms. It should be appreciated that such terms can refer to human entities or automated components supported through artificial intelligence (e.g., a capacity to make inference based on complex mathematical formalisms), which can provide simulated vision, sound recognition and so forth.

It should be noted that although various aspects and embodiments are described herein in the context of 5G or other next generation networks, the disclosed aspects are not limited to a 5G implementation, and can be applied in other network next generation implementations, such as sixth generation (6G), or other wireless systems. In this regard, aspects or features of the disclosed embodiments can be exploited in substantially any wireless communication technology. Such wireless communication technologies can include universal mobile telecommunications system (UMTS), global system for mobile communication (GSM), code division multiple access (CDMA), wideband CDMA (WCMDA), CDMA2000, time division multiple access (TDMA), frequency division multiple access (FDMA), multi-carrier CDMA (MC-CDMA), single-carrier CDMA (SC-CDMA), single-carrier FDMA (SC-FDMA), orthogonal frequency division multiplexing (OFDM), discrete Fourier transform spread OFDM (DFT-spread OFDM), filter bank based multi-carrier (FBMC), zero tail DFT-spread-OFDM (ZT DFT-s-OFDM), generalized frequency division multiplexing (GFDM), fixed mobile convergence (FMC), universal fixed mobile convergence (UFMC), unique word OFDM (UW-OFDM), unique word DFT-spread OFDM (UW DFT-Spread-OFDM), cyclic prefix OFDM (CP-OFDM), resource-block-filtered OFDM, wireless fidelity (Wi-Fi), worldwide interoperability for microwave access (WiMAX), wireless local area network (WLAN), general packet radio service (GPRS), enhanced GPRS, third generation partnership project (3GPP), long term evolution (LTE), 5G, third generation partnership project 2 (3GPP2), ultra-mobile broadband (UMB), high speed packet access (HSPA), evolved high speed packet access (HSPA+), high-speed downlink packet access (HSDPA), high-speed uplink packet access (HSUPA), Zigbee, or another institute of electrical and electronics engineers (IEEE) 802.12 technology.

Various non-limiting aspects of various embodiments described herein are presented in the following clauses.

Clause 1: A system for controlling two separate cooling systems with one radiator, comprising: a cooling circuit with a 3-way valve and a temperature sensor connected to a radiator; a second and separate cooling circuit also connected to the same radiator; a single radiator wherein it has been partitioned into two separate independent surface areas dedicated to each respective circuit; a single radiator that can cool two separate cooling circuits by, acquiring the temperature of a circuit, manipulating a flow valve in a circuit to control coolant flow into a radiator, manipulating a set of screws connected to a set of plungers, that control radiator surface area for each circuit to cool that circuit.

Clause 2: The system of any preceding clause, wherein the radiator lowers the temperature of the fluid of any circuit running through the radiator.

Clause 3: The system of any preceding clause, wherein one cooling system comprising a temperature sensor and a 3-way valve is connected to a radiator.

Clause 4: The system of any preceding clause, wherein the second cooling system is connected to the same radiator as cooling system 1.

Clause 5: The system of any preceding clause, wherein a radiator is partitioned into two separate independent surface areas dedicated to cooling two separate circuits.

Clause 6: The system of any preceding clause, wherein tanks of the radiator are designed as straight tubes with a screw and a plunger in each tank.

Clause 7: The system of any preceding clause, wherein the radiator has an actuator connected to it that can control a set of screws.

Clause 8: The system of any preceding clause, further comprising a set of screws that can control a set of plungers to allocate required radiator surface area.

Clause 9: The system of any preceding clause, further comprising 4 spigots; wherein two of the spigots are for fluid input tanks and the other two are for fluid output tanks.

Clause 10: The system of any preceding clause, further comprising a processor that facilitates the function of the actuator to drive radiator capability.

Clause 11: The system of any preceding clause, further comprising an artificial intelligence model that learns temperature control capability by radiator surface modification control and optimizes cooling for each circuit.

Clause 12: A method for controlling two separate cooling systems with one radiator, comprising: acquiring the temperature for a circuit using the sensors on each circuit; controlling the actuator to drive the screw and plunger mechanism to increase or decrease radiator surface area for each circuit; and recirculating the fluid through each circuit and each radiator partition area to cool the fluid.

Clause 13: The method of any preceding clause, further comprising using temperature sensors to collect the temperature of a circuit.

Clause 14: The method of any preceding clause, further comprising using a 3-way flow valve to control fluid flow into a radiator partition.

Clause 15: The method of any preceding clause, further comprising using each partitioned section of the radiator to cool a specific circuit.

Clause 16: The method of any preceding clause, further comprising using an actuator to drive a set of screws and a set of plungers that can push or pull the plunger to vary circuit dedicated surface area.

Clause 17: The method of any preceding clause, further comprising a processor that facilitates controlling the actuator.

Clause 18: The method of any preceding clause, further comprising an artificial intelligence model that learns temperature control of each circuit by monitoring surface area impact.

Clause 19: A system for controlling two separate cooling systems with one radiator, comprising:

- a cooling circuit (system) with a 3-way valve and a temperature sensor connected to a radiator;
- a second cooling circuit (system) connected to the same radiator as cooling circuit 1, and a single radiator wherein it has been partitioned into two separate independent surface areas dedicated to each respective circuit, and a cooling system for two separate circuits that can cool two separate cooling circuits by, acquiring the temperature of a circuit, manipulating a flow valve in a circuit to control flow into a radiator, and manipulating a set of screws connected to a set of plungers that can control radiator surface area for each circuit to cool that circuit.

Clause 20: The system of any preceding clause, the single radiator cooling system for two separate circuits further comprising of temperature sensors to collect the temperature of a circuit.

In various cases, any suitable combination of clauses 1-11 can be implemented.

In various cases, any suitable combination of clauses 12-18 can be implemented.

In various cases, any suitable combination of clauses 19-20 can be implemented.

What is claimed is:

1. A system, comprising:

a radiator comprising an actuator, an input tank, an output tank that is parallel to the input tank, and a core between the input tank and the output tank, wherein the input tank comprises a first input spigot and a second input spigot, wherein the first input spigot and second input spigot are respectively located closer to opposite ends of the input tank, wherein the output tank comprises a first output spigot and a second output spigot, wherein the first output spigot and second output spigot are respectively located closer to opposite ends of the output tank, wherein the core comprises tubes respectively connecting the input tank and the output tank at different positions along respective lengths of the input tank and output tank, wherein the input tank comprises first plunger inside the input tank, wherein the first plunger is connected to a first screw connecting mechanism configured to move the first plunger up and down at least a portion of the length of the input tank, wherein the output tank comprises second plunger inside the output tank, wherein the second plunger is connected to a second screw connecting mechanism configured to move the second plunger up and down at least a portion of the length of the output tank, wherein the first screw connecting mechanism and the second screw connecting mechanism are connected to a gear and shaft mechanism configured to synchronously drive the first screw connecting mechanism and the second screw connecting mechanism;

a first cooling circuit with comprising a first 3-way valve and a first temperature sensor, wherein the first cooling circuit is connected to the radiator via the first input spigot and the first output spigot;

a second cooling circuit connected to the radiator via the second input spigot and the second output spigot;

an actuator configured to drive the gear and shaft mechanism; and a controller configured to control the actuator to position the first plunger and second plunger in corresponding positions within the input tank and the output tank to adjust respective amounts of fluid flowing through the core directed to the first output spigot and the second output spigot based on a temperature reading of the first temperature sensor.

2. The system of claim 1, wherein the radiator lowers a temperature of the fluid running through the radiator.

3. The system of claim 1, wherein the second cooling circuit comprises a second temperature sensor and a second 3-way valve.

4. The system of claim 1, wherein the second cooling circuit is connected to an air conditioning system.

5. The system of claim 1, wherein the first cooling circuit is connected to an electric drive system.

6. The system of claim 1, wherein the input tank and the output tank are designed as straight tubes.

7. The system of claim 1, wherein the tubes are surrounded by thin metal fins.

8. The system of claim 1, wherein the controller, in response to the temperature reading satisfying a defined criterion indicating that additional cooling is needed in the first cooling circuit, controls the actuator to move the positions of the first plunger and second plunger respectively closer to the second input spigot and the second output spigot.

9. The system of claim 1, wherein the controller, in response to the temperature reading satisfying a defined criterion indicating that less cooling is needed in the first cooling circuit, controls the actuator to move the positions of the first plunger and second plunger respectively closer to the first input spigot and the first output spigot.

10. A vehicle, comprising:

a cooling system, comprising:

a radiator comprising an actuator, an input tank, an output tank that is parallel to the input tank, and a core between the input tank and the output tank, wherein the input tank comprises a first input spigot and a second input spigot, wherein the first input spigot and second input spigot are respectively located closer to opposite ends of the input tank, wherein the output tank comprises a first output spigot and a second output spigot, wherein the first output spigot and second output spigot are respectively located closer to opposite ends of the output tank, wherein the core comprises tubes respectively connecting the input tank and the output tank at different positions along respective lengths of the input tank and output tank, wherein the input tank comprises first plunger inside the input tank, wherein the first plunger is connected to a first screw connecting mechanism configured to move the first plunger up and down at least a portion of the length of the input tank, wherein the output tank comprises second plunger inside the output tank, wherein the second plunger is connected to a second screw connecting mechanism configured to move the second plunger up and down at least a portion of the length of the output tank, wherein the first screw connecting mechanism and the second screw connecting mechanism are connected to a gear and shaft mechanism configured to synchronously drive the first screw connecting mechanism and the second screw connecting mechanism;

a first cooling circuit comprising a first 3-way valve and a first temperature sensor, wherein the first cooling circuit is connected to the radiator via the first input spigot and the first output spigot;

a second cooling circuit connected to the radiator via the second input spigot and the second output spigot;

an actuator configured to drive the gear and shaft mechanism; and a controller configured to control the actuator to position the first plunger and second plunger in corresponding positions within the input tank and the output tank to adjust respective amounts of fluid flowing through the core directed to the first output spigot and the second output spigot based on a temperature reading of the first temperature sensor.

11. The vehicle of claim 10, wherein the radiator lowers a temperature of the fluid running through the radiator.

12. The vehicle of claim 10, wherein the second cooling circuit comprises a second temperature sensor and a second 3-way valve.

13. The vehicle of claim 10, wherein the second cooling circuit is connected to an air conditioning system.

14. The vehicle of claim 10, wherein the first cooling circuit is connected to an electric drive system.

15. The vehicle of claim 10, wherein input tank and the output tank are designed as straight tubes.

16. The vehicle of claim 10, wherein the tubes are surrounded by thin metal fins.

17. The vehicle of claim 10, wherein the controller, in response to the temperature reading satisfying a defined criterion indicating that additional cooling is needed in the first cooling circuit, controls the actuator to move the positions of the first plunger and second plunger respectively closer to the second input spigot and the second output spigot.

18. The vehicle of claim 10, wherein the controller, in response to the temperature reading satisfying a defined criterion indicating that less cooling is needed in the first cooling circuit, controls the actuator to move the positions of the first plunger and second plunger respectively closer to the first input spigot and the first output spigot.

19. A method, comprising:

obtaining, by a processor of a system, a temperature reading from a temperature sensor of a cooling system, wherein the cooling system comprises:

a radiator comprising an actuator, an input tank, an output tank that is parallel to the input tank, and a core between the input tank and the output tank, wherein the input tank comprises a first input spigot and a second input spigot, wherein the first input spigot and second input spigot are respectively located closer to opposite ends of the input tank, wherein the output tank comprises a first output spigot and a second output spigot, wherein the first output spigot and second output spigot are respectively located closer to opposite ends of the output tank, wherein the core comprises tubes respectively connecting the input tank and the output tank at different positions along respective lengths of the input tank and output tank, wherein the input tank comprises first plunger inside the input tank, wherein the first plunger is connected to a first screw connecting mechanism configured to move the first plunger up and down at least a portion of the length of the input tank, wherein the output tank comprises second plunger inside the output tank, wherein the second plunger is connected to a second screw connecting mechanism configured to move the second plunger up and down at least a portion of the length of the output tank, wherein the first screw connecting mechanism and the second screw connecting mechanism are connected to a gear and shaft mechanism configured to synchronously drive the first screw connecting mechanism and the second screw connecting mechanism;

a first cooling circuit comprising a first 3-way valve and the temperature sensor, wherein the first cooling circuit is connected to the radiator via the first input spigot and the first output spigot;

a second cooling circuit connected to the radiator via the second input spigot and the second output spigot; and an actuator configured to drive the gear and shaft mechanism; and controlling, by the processor, the actuator to position the first plunger and second plunger in corresponding positions within the input tank and the output tank to adjust respective amounts of fluid flowing through the core directed to the first output spigot and the second output spigot based on the temperature reading of the temperature sensor.

20. The method of claim 19, wherein the controlling comprises:

in response to the temperature reading satisfying a first defined criterion indicating that additional cooling is needed in the first cooling circuit, controlling the actuator to move the positions of the first plunger and second plunger respectively closer to the second input spigot and the second output spigot; and in response to the temperature reading satisfying a second defined criterion indicating that less cooling is needed in the first cooling circuit, controlling the actuator to move the positions of the first plunger and second plunger respectively closer to the first input spigot and the first output spigot.

* * * * *